United States Patent [19]

Noguchi et al.

[11] 4,185,596

[45] Jan. 29, 1980

[54] TWO-STROKE CYCLE GASOLINE ENGINE

[75] Inventors: Masaaki Noguchi, Nagoya; Yukiyasu Tanaka; Isao Igarashi, both of Okazaki, all of Japan

[73] Assignee: Toyota Jidosha Kogyo Kabushiki Kaisha, Toyota, Japan

[21] Appl. No.: 917,241

[22] Filed: Jun. 20, 1978

[30] Foreign Application Priority Data

Apr. 28, 1978 [JP] Japan ..... 53-52105

[51] Int. Cl.[2] ..... F02B 25/08

[52] U.S. Cl. ..... 123/51 B; 123/70 R

[58] Field of Search ..... 123/51 B, 70 R, 70 V

[56] References Cited

U.S. PATENT DOCUMENTS

| | | | |
|---|---|---|---|
| 1,474,549 | 11/1923 | Penning | 123/70 R |
| 2,167,946 | 8/1939 | Gray | 123/70 R |
| 2,267,479 | 12/1941 | Sturm et al. | 123/70 R |
| 2,281,821 | 5/1942 | Balmer | 123/70 R |
| 2,347,444 | 4/1944 | Vincent | 123/70 R |
| 2,374,460 | 4/1945 | Rossman | 123/70 R |
| 2,434,584 | 1/1948 | Purdie | 123/51 B |
| 2,939,441 | 6/1960 | Luttrell | 123/70 R |
| 3,198,179 | 8/1965 | Stephens | 123/51 B |

*Primary Examiner*—Ira S. Lazarus

*Attorney, Agent, or Firm*—Finnegan, Henderson, Farabow & Garrett

[57] ABSTRACT

A two-stroke cycle gasoline engine including at least one two-stroke power cylinder-piston assembly incorporating uniflow scavenging and two horizontally opposed pistons, and at least one scavenging pump cylinder-piston assembly of the reciprocating type, wherein the total stroke volume of the scavenging pump assembly is 1.15–1.65 times as large as that of the power cylinder-piston assembly, and the operational phase relation between the power and pump cylinder-piston assemblies is so determined that the top dead center of a pump cylinder-piston assembly is, as viewed in the crank angle diagram, in a range between 15° in advance of and 15° behind the midpoint between the bottom dead center and the scavenging port closing phase point of the power cylinder-piston assembly to which the pump cylinder-piston assembly supplies scavenging mixture.

9 Claims, 8 Drawing Figures

TWO-STROKE CYCLE GASOLINE ENGINE

BACKGROUND OF THE INVENTION

The present invention relates to a two-stroke cycle gasoline engine, and, more particularly, to a two-stroke cycle gasoline engine adapted for use with automobiles.

A two-stroke cycle engine has theoretically the advantage that an engine of a certain size can generate a greater power than a four-stroke cycle engine of a bigger size because the two-stroke cycle engine has twice as many work cycles per revolution as the four-stroke cycle engine. In fact, however, the conventional two-stroke cycle gasoline engine employing a carburetor has such drawbacks that it has high fuel consumption as compared with the four-stroke cycle engine due to the loss of air-fuel mixture caused by the direct escape, i.e. blow-out, of scavenging mixture to an exhaust manifold during scavenging, and that it cannot generate such a high power as expected from the fact that it has twice as many work strokes as the corresponding four-stroke cycle engine, due to the fact that the scavenging is still insufficient. Because of these problems, the practical use of two-stroke cycle gasoline engines is nowadays limited to the field of small engines which must be simple in structure and low in manufacturing cost.

Conventional two-stroke cycle gasoline engines of the abovementioned type, therefore, generally employ crankcase compression for scavenging. However, the scavenging by crankcase compression is not fully effective and can only provide a relatively low volumetric efficiency. This is the principal cause of the poor output power of conventional two-stroke cycle gasoline engines. In fact, a volumetric efficiency as high as 80% is available in four-stroke cycle engines, while on the other hand the volumetric efficiency of typical two-stroke cycle engines is still as low as 40–50%. The pump stroke volume of crankcase compression is equal to the stroke volume of the engine. However, since the crankcase has a relatively large clearance volume, the compression ratio of crankcase compression is relatively low, so that as a result the amount of air-fuel mixture drawn to the crankcase is small, the amount of delivered mixture is small, the delivery pressure is low and hence the scavenging pressure is low, and consequently it is hard to supply a really adequate amount of scavenging mixture into the power cylinder. As a result, the delivery ratio obtained in an engine wherein scavenging is effected only by the normal crankcase compression is only as high as 0.5–0.8. Since further the trapping efficiency is about 0.7, the volumetric efficiency becomes as low as 40–50% as mentioned above.

The purpose of scavenging is to push the residual exhaust gases in the power cylinder out of it by fresh mixture, and therefore if the pressure of the residual exhaust gases and the distance between the scavenging port and the exhaust port are given, the time required for completing scavenging is determined, provided that stratified scavenging is performed. Now, if the scavenging pressure is low, as when crankcase compression is used, a relatively long time is required for completing scavenging, particularly when the scavenging is performed by uniflow scavenging, and therefore, when the engine is rotating at high speed, it may well occur that the exhaust port is closed before the scavenging is completed so that a large amount of exhaust gases still remains in the power cylinder, and thereby only a very small amount of fresh mixture is charged into the power cylinder. Therefore, conventional two-stroke cycle engines have been unable to operate satisfactorily in the high speed range.

Furthermore, when scavenging depends upon the crankcase compression, since a power piston operates as a pump piston, as a matter of course the operational phase of the scavenging pump means is shifted from that of the power cylinder-piston assembly to which it supplies scavenging mixture by exactly 180°, so that when the power piston of the power cylinder-piston assembly reaches its bottom dead center (BDC), the pump piston of the pump cylinder-piston assembly (which is identical with the power piston) simultaneously reaches its top dead center (TDC). In the present description the dead center at the end of compression stroke is called "top dead center" and the opposite dead center is called "bottom dead center". However, as apparent from the crank angle diagram of FIG. 1, the usable scavenging period of the power cylinder-piston assembly extends after BDC of the power piston so that half of it is still left when the power piston reaches its BDC, and in spite of this since at this point the pump piston begins to retreat towards its BDC the pressure in the crankcase greatly lowers, as shown in FIG. 2, so that although the scavenging port is still open the scavenging period is not effectively utilized.

Therefore, it is an object of the present invention not to use crankcase compression for scavenging, but instead to use an independent scavenging pump means having a small clearance volume and a high compression ratio so that the volumetric efficiency of the scavenging pump means is substantially increased and so that the delivery amount of the scavenging pump means is substantially increased, for a fixed total stroke volume of the scavenging pump means. In this connection, another object of the present invention is further to increase the total stroke volume of the scavenging pump means so as to be 1.15–1.65 times as large as the total stroke volume of the power cylinder-piston assembly, so that this, in combination with the use of an independent scavenging pump means, provides substantially increased pressure and amount of scavenging mixture when compared with crankcase compression. In this case, therefore, the power cylinder is scavenged by mixture of no lower pressure and amount than if it is scavenged by mixture supplied by, for instance, a particular crankcase compression system employing a stepped piston and having an increased stroke volume such as 1.35–1.85 times as large as the stroke volume of the power piston. Thus, in accordance with the present invention, high pressure and amount of scavenging mixture necessary for scavenging the power cylinder at high scavenging efficiency are ensured, and if this feature is combined with employing the optimum phase difference between the scavenging pump means and the power means, as explained hereinunder, the volumetric efficiency of the power cylinder can be increased to as much as 75–100%, whereby a two-stroke cycle gasoline engine of the present invention can generate substantially higher power per unit stroke volume of the engine than a conventional two-stroke cycle gasoline engine.

In the present description the total stroke volume of a power cylinder-piston assembly of an engine means the total stroke volume displaced by the power piston when it moves between its bottom dead center and its top dead center, and therefore the effective stroke volume displaced by the power cylinders after the exhaust port is closed by the power piston until they reach TDC is smaller than this aforementioned total stroke volume. Furthermore, when two or more power cylinder-piston assemblies are included in the engine, the total stroke volume of the engine as defined here is the value which is obtained by multiplying the number of power cylinder-piston assemblies by the abovedefined total stroke volume of each power cylinder-piston assembly. The total stroke volume of the pump means the sum of the volume or volumes displaced by the pump piston or pistons while it or they move during their compression stroke.

In connection with the abovementioned objects of the present invention, another object of the present invention is, by the use of an independent scavenging pump means instead of crankcase compression, and by the increase of scavenging pressure, to shorten the time required for scavenging so that the scavenging efficiency is increased up to 80–90% and high power operation of a two-stroke cycle gasoline engine is ensured even in a relatively high-speed operational range.

However, it is to be noted that the relatively high speed operational region contemplated in the present invention means such an operational region in which the conventional, particularly the uniflow scavenging type, two-stroke cycle gasoline engine is unable to operate with sufficient output power, due to insufficient scavenging at high rotational speed. In fact, the aforementioned relatively high-speed rotational region is located in a lower speed region than the high rotational speed region of conventional automobile four-stroke cycle gasoline engines, as explained hereinunder. Therefore, it is still another object of the present invention to provide a two-stroke cycle gasoline engine which can operate in such a lower speed operational region so as to generate sufficient output power. Conventionally, a relatively small-sized four-stroke cycle engine for automobiles is designed so as to be operated at relatively high rotational speed so that relatively high power output is available from a relatively small size engine. In this connection, it is noted that, for example, in the case of an engine which has a two liter piston displacement and produces 92 PS of brake horsepower at 5000 rpm, a large proportion of the power, such as 52 PS out of the indicated power of 144 PS, is consumed by internal friction losses in the engine. The ratio of the internal friction loss to the output power of the engine is substantially reduced by lowering the rotational speed of the engine. In view of this, still another object of the present invention is to utilize the advantage of the fact that a two-stroke cycle engine has twice as many work strokes as a four-stroke cycle engine by increasing the volumetric efficiency of the power cylinder, and to provide an engine which produces high effective power output per unit stroke volume of the engine without increasing the rotational speed to such a high range as in conventional relatively small four-stroke cycle automobile engines. The maximum rotational speed of the engine contemplated in the present invention is 3800 rpm.

As methods of scavenging in two-stroke cycle engines are conventionally known cross scavenging, loop scavenging, and uniflow scavenging. In this connection, and in connection with the aforementioned high pressure scavenging contemplated in the present invention, if the scavenging pressure is increased in cross or loop scavenging, the flow of scavenging mixture is liable to penetrate through the layer of exhaust gases existing in the power cylinder in a short-cutting manner, and also scavenging mixture and exhaust gases may be mixed with each other, thereby not only causing poor scavenging but also increasing the above-explained blow-out loss of mixture, thus lowering the volumetric efficiency. On the other hand, it has been experimentally confirmed that, when uniflow scavenging is employed, it is possible to push the exhaust gases existing in the power cylinder uniformly out of it by the scavenging mixture at high pressure without causing any detrimental mixing between the scavenging mixture and the exhaust gases.

Therefore, it is still another object of the present invention to provide a two-stroke cycle gasoline engine in which high pressure scavenging and uniflow scavenging are combinedly incorporated.

Furthermore, the present invention proposes as an important feature to provide a particular operational phase relation between a power cylinder-piston assembly and a pump cylinder-piston assembly which supplies scavenging mixture to the pump cylinder-piston assembly such that the top dead center of the pump cylinder-piston assembly is, as viewed in the crank angle diagram, in a range between 15° in advance of and 15° behind the midpoint between the bottom dead center and the scavenging port closing point of the power cylinder-piston assembly. This is so determined for the following reasons.

From the viewpoint of increasing the volumetric efficiency of the power cylinder-piston assembly it is desirable that scavenging mixture should be supplied to the power cylinder-piston assembly over the entire scavenging period shown in the crank angle diagram of FIG. 1. However, when for example a power cylinder-piston assembly is supplied with scavenging mixture by a single acting pump cylinder-piston assembly driven by the power cylinder-piston assembly in synchronization therewith with a phase difference, if the TDC of the pump is at the phase position Sc at which the scavenging port of the power cylinder-piston assembly closes, in order to satisfy the aforementioned entire-period scavenging, the crank angle between the BDC of the pump piston and the phase position So at which the scavenging port of the power cylinder-piston assembly opens becomes small. This means that the stroke which the pump piston moves from the beginning of the pump compression stroke until the scavenging port opens is relatively small and that therefore the scavenging pressure which is available when the scavenging port is first opened is relatively low. Therefore, the phase difference between the scavenging port opening phase So and pump BDC must be greater than a predetermined value, so that an object of the present invention, which is to perform scavenging by employing mixture at high pressure, may be accomplished. In accordance with the present invention, when a greater importance is given to the high rotational speed performance of the engine, it is contemplated that the scavenging pressure at the time of opening of the scavenging port (So) should be 0.5–0.6 atm (gauge pressure). The scavenging pressure at the opening of the scavenging port (So) is determined by various factors such as the volumetric efficiency of the pump, compression ratio of the pump at So which is determined by the clearance volume of the pump and the passages extending from the pump to the scavenging port and the length of the pump piston stroke between pump BDC and the point So, and suction and delivery inertia of the pump, etc. When a reed valve is provided in the vicinity of the scavenging port for the purpose of preventing blow-back, the scavenging pressure immediately after the point So is affected by the transient response performance of the reed valve. When the responsiveness of this reed valve is low, i.e. its opening is retarded, the scavenging pressure temporarily lowers after So. Therefore, in consideration of all these factors, crank angle difference between the pump BDC and the scavenging port opening phase point So is determined.

On the other hand, even when the pump piston reaches its TDC at a middle portion of the latter half of the scavenging period, i.e. the period between power piston BDC and scavenging port closing phase point Sc, the scavenging pressure will not in fact immediately lower to zero, as the flow of scavenging mixture is maintained for a certain period after pump TDC, due to the time required for the scavenging mixture to flow from the pump to the scavenging port, the inertia of the scavenging mixture, the retardation effect that the scavenging mixture enters into the power cylinder only after a certain time delay due to the throttling effect applied to the scavenging mixture when it flows through the delivery port of the pump, retardation caused in the flow of scavenging mixture due to delay in response of a reed valve when such a valve is provided, etc. Therefore, even when pump TDC is situated at a middle portion of the latter half of the scavenging period, it can happen that in fact scavenging mixture flows into the power cylinder over the entire region of the scavenging period. In this connection, the time required for the mixture from the scavenging pump to enter into the power cylinder through the scavenging port is determined by the pressure difference across the scavenging port and the throttling ratio of the scavenging port, and this time is not directly concerned with the rotational speed of the engine. On the other hand, the time lapse between pump TDC and the scavenging port closing phase point Sc is shorter as the rotational speed of the engine is higher. Therefore the importance of the crank angle difference between pump TDC and the point Sc varies in accordance with the design of the engine depending to which rotational speed of the engine the most importance is given. From this point of view, therefore, it is not very important that pump TDC should be brought closer to Sc. In consideration of the various abovementioned factors, as a result of experimental researches we have obtained the abovementioned condition with regard to the phase position of pump TDC.

The particular phase position within the aforementioned phase range at which pump TDC is actually positioned is determined in consideration of various factors such as the magnitude of crank angle between So and Sc, the aforementioned factors for determining the scavenging pressure at So, factors for determining the time required for the scavenging mixture to finish flowing into the power cylinder after pump TDC, what rotational speed of the engine is considered most important in the design of the engine, etc. Then an engine is manufactured for experimental tests, and is tested with regard to how the performance of the engine changes in accordance with modifications of various factors and conditions as mentioned above. As a result of such experiments it is possible to determine the particular design of the engine which has the most desirable performance in view of the objects of the present invention.

In the system wherein TDC of a pump piston is at the same phase point as BDC of a power piston the scavenging pressure at the scavenging port opening phase point So becomes very high. Therefore, in such a system, resort is often had to the provision of a mixture tank between the pump and the power cylinder-piston assembly so as to increase the base volume involved in the scavenging system and so as to lower the scavenging pressure at the scavenging port opening phase. When a mixture tank is employed, a reed valve is provided between the pump and the mixture tank, and in the part of the scavenging period after pump TDC the scavenging mixture is only moderately delivered at low pressure from the tank and the effectiveness of the scavenging is reduced. On the other hand, if the clearance volume of the pump is increased (this corresponds to the case wherein no reed valve is provided between the pump and the mixture tank), the compression ratio of the pump lowers, and the suction and delivery performance of the pump also lowers. However, if the scavenging pressure is very high, the scavenging mixture will blow-out to the exhaust manifold through the residual exhaust gases existing in the power cylinder, or the scavenging mixture will mix with the exhaust gases so as also to cause blow-out of scavenging mixture to the exhaust manifold. However, in accordance with the present invention, the scavenging pressure is maintained at a proper level without employing a mixture tank or without providing an additional clearance volume in the pump, thereby effectively utilizing scavenging mixture. In accordance with the present invention, in order to improve pump performance and effective utilization of scavenging mixture, it is rather desirable that the clearance volume should be as small as possible, and that when blow-back from the power cylinder does not occur, and when pump TDC is not very close to power piston BDC, no reed valve should be provided in the scavenging passage.

As mentioned above, in accordance with the present invention, when predominance is given to the performance of the engine in high rotational speed operation, the scavenging pressure is increased up to the order of 0.5–0.6 atm (gauge pressure). Such a high scavenging pressure is not available from conventional crankcase compression. With conventional crankcase compression generally only scavenging pressure of about 0.3–0.35 atm is available, and in the case of an engine having new and particularly improved design scavenging pressure of 0.45 atm is available at the highest. The use of a higher scavenging pressure in the present invention is based upon the recognition that since the time required for the scavenging mixture to flow into the power cylinder and to push the exhaust gases out of the exhaust port is determined by the pressure difference between the scavenging pressure and exhaust pressure and the distance to be travelled by the scavenging mixture while it flows from the scavenging port to the exhaust port, and is not directly concerned with the rotational speed of the engine, if scavenging is to be completed before the exhaust port is closed by the power piston in high speed operation of the engine, the quantity of scavenging mixture must be increased. The volumetric efficiency of a reciprocating piston pump can exceed 100% at a certain rotational speed, if it is properly designed. However, since the rotational speed widely varies in the case of an automobile engine, if the volumetric efficiency of the power cylinder is to be increased up to 75–100% or more, the amount of scavenging mixture must be increased. In view of this, as mentioned above the present invention contemplates to employ an independent pump cylinder-piston assembly having total stroke volume 1.15–1.65 times as large as the total stroke volume of the power cylinder-piston assembly. However, as explained above, even in uniflow scavenging, if the amount of scavenging mixture is too much increased, blow-out of scavenging mixture to the exhaust manifold increases. The ratio of 1.65 proposed by the present invention as the upper limit of the ratio of the total stroke volume of a pump cylinder-piston assembly to that of a power cylinder-piston assembly has been experimentally obtained as the upper limit for avoiding an undesirable degree of blow-out of mixture to the exhaust manifold if the combination of the performance of the change of scavenging pressure and the scavenging period is favorably adjusted.

For example, let us assume that the volumetric efficiency of a pump is 80%, and that 85% of the scavenging mixture delivered from the pump is actually supplied to the power cylinder due to obstruction by a reed valve, etc. Further, let us assume that the mean pressure of the scavenging mixture in the power cylinder is 1.3 atm (absolute pressure). Then, expressing the stroke volume of one power cylinder-piston assembly by Va, and assuming the stroke volume of one pump cylinder-piston assembly which supplies scavenging mixture to said power cylinder-piston assembly to be 1.65 Va, the scavenging volume Vsc of the power cylinder is:

$$Vsc = 1.65\ Va \times 0.8 \times 0.85 \times 1/1.3 = 0.86\ Va$$

Assuming that the power cylinder-piston assembly is of the uniflow opposed piston type, the volume Vec confined in the power cylinder by a pair of pistons when the exhaust side piston closes the exhaust port is expressed by:

$$Vec = Va - 2 \times (\text{stroke volume displaced by the exhaust side power piston while it moves from its } BDC \text{ until it closes the exhaust port}) + (\text{volume of combustion chamber defined between the power pistons at their } TDC)$$

If the second term in the above formula is, for example, 0.30 Va, and if the third term is 0.16 Va (i.e. compression ratio is assumed to be 7.25), $$Vec = (1 - 0.30 + 0.16)\ Va = 0.86\ Va$$

Therefore, in this case:

$$Vec = Vsc,$$

and this means that scavenging mixture pushes combustion gases completely out of the power cylinder and the scavenging mixture itself is completely retained in the power cylinder with its exhaust port being closed. If there is no leakage of scavenging mixture from the exhaust port, the volumetric efficiency of the power cylinder is $0.86 \times 1.3 = 1.65 \times 0.8 \times 0.85 = 1.12$, i.e. 112%.

On the other hand, the lower limit of 1.15 with regard to the ratio of the stroke volume of a pump cylinder-piston assembly to the stroke volume of a power cylinder-piston assembly is the value which is considered to be necessary in order to accomplish the objects of the present invention in view of such matters as that, when the engine is small-sized, in some uses a volumetric efficiency of the power cylinder of the order of 75% is acceptable, that high volumetric efficiency of the pump is available by proper design when the engine is normally operated in a relatively narrow range of rotational speed, etc.

Furthermore, currently there exists a great demand for the development of cars which have low fuel consumption, in view of energy saving. Furthermore, cars must satisfy a high standard with regard to the prevention of air pollution. In order to improve fuel consumption, not only the improvement of the fuel consumption of the engine itself but also the reduction of the weight and the air resistance of the vehicle are required. We have noted, in connection with various running tests carried out to prepare for the qualification tests for conforming to the standards for the prevention of air pollution which are becoming more severe nowadays, that fuel consumption is different in summer and in winter due to the difference of atmospheric air density, and we more keenly recognized that the air resistance of the vehicle has an important effect on the fuel consumption of the vehicle even in low speed running. In order to lower the air resistance of the vehicle it is important to reduce the height of the vehicle as much as possible and to form the external shape of the vehicle in a streamlined shape. Particularly it is very effective to lower the engine hood. In order to reduce the height of the vehicle it is effective to eliminate the drive shaft for driving the rear wheels so that the shaft tunnel is eliminated and a flat floor is available, over the entire floor area, thereby constructing a vehicle body having a low floor and a low roof. A method for accomplishing this is to employ the FF system, i.e. the front engine - front drive system. In order to lower the engine hood by a large amount in an automobile employing the FF system while ensuring necessary leg room for the driver and the front seat passenger, it is necessary to reduce substantially the height and length of the engine compartment. Furthermore, in order to reduce the air resistance of the vehicle, it goes without saying that the frontal area of the vehicle must be reduced. Therefore, the width of the vehicle should be minimized. Furthermore, since the transmission, differential gears, and other driving mechanisms must be housed in the engine compartment together with the engine, in the FF system, the space allowed for the engine is much reduced. Light trucks are often designed with the engine mounted under the driver's seat, and in such a design the engine, being relatively long, often extends so far backward as to make a hump of the engine enclosure rearward of the cabin, thus shortening the deck.

It is therefore still another object of the present invention to deal with the aforementioned problems and requirements and to provide a small size gasoline engine having a low height, a small length and not a very large width, yet being capable of generating high power.

As uniflow scavenging engines are known an engine having horizontally opposed pistons, an engine having an exhaust poppet valve, etc. In order to accomplish the aforementioned objects of the present invention, we now consider an engine having horizontally opposed pistons. That is, it is found that an engine having a power cylinder-piston assembly employing horizontally opposed pistons is particularly advantageous.

Therefore, in order to accomplish the aforementioned objects, the present invention proposes to employ at least one two-stroke cycle power cylinder-piston assembly incorporating uniflow scavenging and two horizontally opposed pistons as the power cylinder-piston assembly of the engine. By combining such a power cylinder-piston assembly with the aforementioned concept of high flow and pressure of scavenging mixture and also with the particular phase condition, it is possible to charge the power cylinder with fresh mixture with high volumetric efficiency without causing substantial blow-out of scavenging mixture to the exhaust manifold, and because of this, it is possible to obtain an engine of reduced height and length having the high power generating ability even at relatively low rotational speed, when compared with a conventional four-stroke cycle engine. Furthermore, in contrast to the emission performance of the conventional two-stroke cycle gasoline engine, which shows high concentration levels of HC in the exhaust gases, such as 5–10 times as high as those of the conventional four-stroke cycle gasoline engine, the engine of the present invention is able, due to substantial avoidance of blow-out of scavenging mixture to the exhaust manifold, to keep HC concentration in the exhaust gases at a sufficiently low level.

In connection with the aforementioned concept of employing at least one two-stroke cycle power cylinder-piston assembly incorporating uniflow scavenging and two horizontally opposed pistons as the power cylinder-piston means of the engine, the present invention further proposes to employ at least one pump cylinder-piston assembly of the reciprocating type as the scavenging pump means. By employing such a pump cylinder-piston assembly it is possible to ensure the necessary amount and pressure of scavenging mixture even in low speed operation and it is also possible to construct the scavenging pump with a simpler and less expensive structure.

When compared with this, if a rotary pump is employed, although the advantage that scavenging mixture is supplied to the scavenging ports throughout the entire scavenging region is obtained on the one hand, on the other hand scavenging pressure is constantly applied to the scavenging port even during the non-scavenging period, whereby it may happen that scavenging mixture should leak through the clearance between the power cylinder and the piston, thereby increasing the pumping loss, thereby causing a great disadvantage in the case of a small-sized engine. In contrast, when a reciprocating piston pump is employed, the operational phase of the piston can be properly matched to the operational phase of a power cylinder-piston assembly so that the required scavenging pressure is generated only when it is required by the power cylinder-piston assembly.

In this connection, furthermore, if a pump cylinder-piston assembly incorporating horizontally opposed pistons is employed as a reciprocating pump in combination with the aforementioned two-stroke cycle power cylinder piston assembly incorporating uniflow scavenging and horizontally opposed pistons, another advantage is obtained in that more desirable harmony between the dimensions of the power cylinder-piston assembly and of the pump cylinder-piston assembly is available.

In more detail, a two-stroke cycle power cylinder-piston assembly incorporating uniflow scavenging and horizontally opposed pistons has a volume to be scavenged slightly more than twice as much as the stroke of the individual pistons. Therefore, if the power cylinder must be scavenged by a scavenging pump having a single piston, either the diameter of the pump cylinder or the stroke of the pump piston must be relatively large. In either case, in view of the fact that the total stroke volume of the scavenging pump means is to be 1.15–1.65 times as large as the total stroke volume of the power cylinder-piston assembly, particularly since crankcase compression is not employed, it is apprehended that either the width or the length of the scavenging pump means may become too large compared with those of the power cylinder-piston assembly. However, if the scavenging pump means is provided as a pump cylinder-piston assembly having horizontally opposed pistons, it is possible to maintain both the diameter of the pump cylinder and the stroke of the pump piston within reasonable values so as to provide desirable harmony with the power cylinder-piston assembly. When such a pump cylinder-piston assembly is arranged horizontally side by side with a power cylinder piston assembly of the same type having horizontally opposed pistons, the engine presents a compact overall configuration like a horizontally flat block, rectangular in a plan view. An engine for a small size or light automobile will comprise, at the most, one or two two-stroke cycle power cylinder-piston assemblies of the aforementioned type incorporating uniflow scavenging and horizontally opposed pistons. In this case the balancing of the scavenging pump is important. If one power cylinder-piston assembly incorporating uniflow scavenging and horizontally opposed pistons is served by a single cylinder-single piston scavenging pump, the pump piston will become relatively large, requiring a relatively large counterweight, resulting in a relatively large crankcase, yet perfect balancing of reciprocating masses will not be attained. However, if the pump is a cylinder-piston assembly having horizontally opposed pistons, inertial forces of the reciprocating masses related to individual opposed pistons are perfectly balanced, whereby the crankcases for individual pistons are substantially reduced in size together with reduction of the height and length of the engine, thereby providing a compact two-stroke cycle engine of the horizontally opposed piston type less prone to vibration.

However, the differences of engine volume and of dynamic balance between a single piston scavenging pump and an opposed piston scavenging pump will become less important as the engine becomes smaller, while on the other hand if the engine becomes smaller, the difference in manufacturing cost, which is governed by structural complexity, will become more important. Therefore, it must be individually decided according to various conditions which of the two factors should have priority over the other. When a pump cylinder-piston assembly having horizontally opposed pistons is employed as the scavenging pump means, the reciprocating inertia forces in the pump means are well balanced, and this, in combination with a power cylinder-piston assembly of the same horizontally opposed piston type in which the reciprocating inertia forces are also well balanced, can provide a well balanced, less prone to vibration, and quiet engine.

With respect to a pair of crankshafts of the power and pump cylinder-piston assemblies of the horizontally opposed piston type, if they are rotated in opposite directions, moments produced by forces perpendicular to the crankshafts are also balanced. However, this requires incorporating a rotation reversing mechanism including an idle gear between the two crankshafts, and therefore increases manufacturing cost. Therefore, as an embodiment of the present invention, it is proposed to connect drivingly a pair of crankshafts of the power and pump cylinder-piston assemblies of the horizontally opposed piston type simply by an endless chain so that the two crankshafts rotate in the same direction. In this regard, it is a matter of choice between pursuing quietness of vibration in engine operation and pursuing reduction of cost to select the system of mutual counterrotation of a pair of crankshafts or to select the system of rotation in the same direction of a pair of crankshafts, and this is, in any event, a matter of design with regard to the engine of the present invention.

When the two-stroke cycle gasoline engine of the present invention comprises, for example, two two-stroke cycle power cylinder-piston assemblies, since the crankcases of these power cylinder-piston assemblies are not utilized for crankcase compression of scavenging mixture, the scavenging pump means to serve for the two power cylinder-piston assemblies must have a relatively large capacity. Therefore, even when the scavenging pump is constructed as a pump cylinder-piston assembly having horizontally opposed pistons, a single acting pump cylinder-piston assembly of the horizontally opposed piston type will not be sufficient to supply the necessary flow of scavenging mixture. Furthermore, when two power cylinder-piston assemblies are combined to operate with phase difference of 180° therebetween, another difficulty is encountered with regard to the matching of the operational phase of the scavenging pump to that of the power cylinder-piston assemblies. In view of these problems, the present invention further proposes to employ a double acting pump cylinder-piston assembly having horizontally opposed pistons so as to make the two actions of the pump pistons serve for the scavenging of the first and second power cylinder-piston assemblies, respectively. By this arrangement, it is possible to supply scavenging mixture to two power cylinder-piston assemblies by using one pump cylinder-piston assembly while maintaining harmony between the dimensions of the power cylinder-piston assemblies and of the pump cylinder-piston assembly, and thus an engine having high power output relative to its volume is obtained.

SUMMARY OF THE INVENTION

In view of the various problems with regard to the conventional art and of the various objects and features of the present invention discussed above, in summary the present invention proposes a two-stroke cycle gasoline engine comprising at least one two-stroke cycle power cylinder-piston assembly incorporating uniflow scavenging and two horizontally opposed pistons, and at least one scavenging pump cylinder - piston assembly of the reciprocating type and driven by said power cylinder-piston assembly in synchronization therewith with a phase difference, wherein the total stroke volume of said pump cylinder-piston assembly is between 1.15 and 1.65 times as large as that of said power cylinder-piston assembly, and said phase difference between said power and pump cylinder-piston assemblies is so determined that the top dead center of a pump cylinder-piston assembly is, as viewed in the crank angle diagram, in a range between 15° in advance of and 15° behind the midpoint between the bottom dead center and the scavenging port closing phase point of the power cylinder-piston assembly to which it supplies scavenging mixture.

BRIEF DESCRIPTION OF THE DRAWING

The present invention will become more fully understood from the detailed description given hereinbelow and the accompanying drawings which are given by way of illustration only, and thus are not limitative of the present invention, wherein.

DESCRIPTION OF THE PREFERRED EMBODIMENTS

Figure 3:
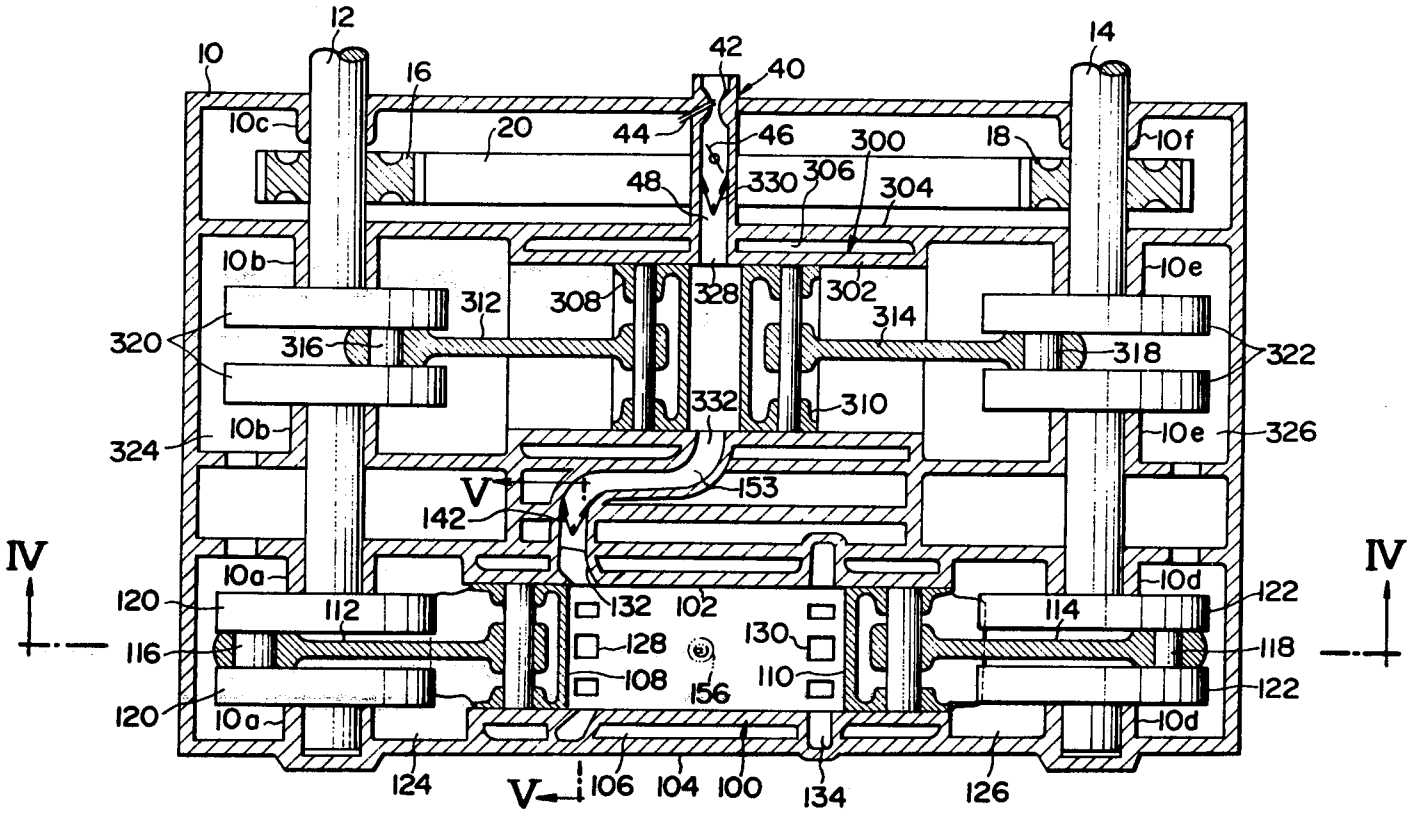
FIG. 3 is a diagrammatical plan sectional view showing a first embodiment of the two-stroke cycle gasoline engine of the present invention.
Figure 4:
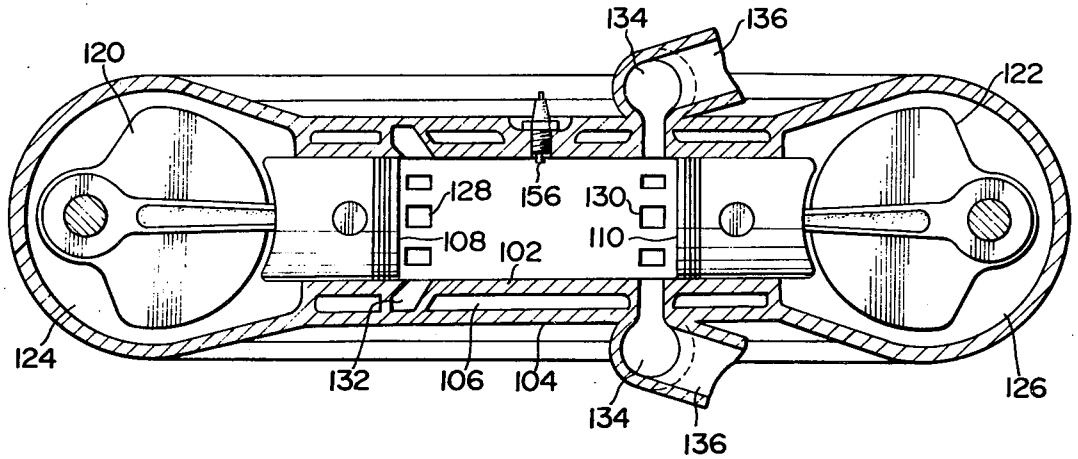
FIGS. 4 and 5 are sectional views along lines IV—IV and V—V in FIG. 3, respectively.
Figure 5:
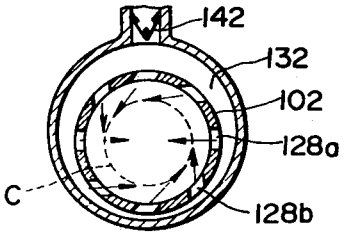

Referring to FIGS. 3–5, showing the first embodiment of the present invention, the two-stroke cycle gasoline engine herein shown comprises a cylinder block 10, the overall shape of which is like a relatively flat block rectangular in a plan view and adapted to be installed with one of its biggest two out of six faces arranged horizontally. In the cylinder block there are provided a pair of crankshafts 12 and 14 which are arranged along the opposite edges of the cylinder block and are rotatably supported by bearings 10*a*–10*c* and 10*d*–10*f*, respectively. In this embodiment, for example, crankshaft 12 may be connected to auxiliaries of the engine while on the other hand the crankshaft 14 may serve as the power output shaft of the engine. In the cylinder block 10 there are incorporated a power cylinder-piston assembly 100 and an independent reciprocating type scavenging pump means 300, which is in this embodiment a pump cylinder-piston assembly having horizontally opposed pistons.

First, the power cylinder-piston assembly 100 will be described. The assembly includes a power cylinder 102 supported by the cylinder block 10. The power cylinder is surrounded by a cooling jacket 106 defined by a jacket wall 104. In the cylinder 102 are arranged two power pistons 108 and 110, one being located on the scavenging side or the left side in the figure while the other is located on the exhaust side or the right side in the figure, respectively. The pistons 108 and 110 are individually connected with connecting rods 112 and 114, which in turn are individually connected with crankpins 116 and 118. The crankpins 116 and 118 are individually supported by crank arms 120 and 122. The two crank mechanisms each including the crank arms and the crank pin are individually housed in crankcases 124 and 146. Since in this case no crankcase compression is involved, the crank cases may have any clearance volume.

The cylinder 102 has a plurality of scavenging ports 128 in its scavenging side and a plurality of exhaust ports 130 in its exhaust side. These scavenging ports and exhaust ports are connected with a scavenging plenum 132 and an exhaust plenum 134, respectively. The exhaust plenum 134 is connected with exhaust pipes 136. As shown in FIG. 5, the scavenging ports 128 are composed of two groups of scavenging ports, wherein the first group of scavenging ports 128*a* open toward the central axis of the power cylinder 102, while on the other hand the second group of scavenging ports 128*b* open along axes tangential to a phantom cylinder C coaxial with the cylinder 102. Furthermore, the scavenging ports 128*a* and 128*b* are inclined toward the exhaust side so that the flow of scavenging mixture discharged from these scavenging ports have a velocity component toward exhaust ports 130. Thus, scavenging mixture discharged from the scavenging ports 128*b* flows through the cylinder 102 toward the exhaust side by forming spiral flows, while on the other hand the flows of scavenging mixture discharged from the scavenging ports 128*a* collide with each other at the center of the cylinder 102 and push the combustion gases remaining along the central axis of the cylinder out of it. At a longitudinally central portion of cylinder 102 is provided a spark plug 156.

Next, the pump 300 will be described. The pump includes a pump cylinder 302 supported by the cylinder block 10. The pump cylinder 302 is surrounded by a cooling jacket 306 defined by a jacket wall 304. This cooling jacket serves to remove the compression heat of mixture generated in the pump 300 so as to increase the volumetric efficiency of the pump, while further when the engine is operated in cold weather it serves to warm the pump cylinder so as to expedite atomization of the gasoline. For this purpose, the cooling jacket 306 is connected with the cooling jacket 106 of the power cylinder by a passage means not shown in the figure. In the pump cylinder 302 are provided a pair of pump pistons 308 and 310 as opposed to each other. The pistons 308 and 310 are individually connected with connecting rods 312 and 314 which in turn are individually connected with crankpins 316 and 318. The crankpins 316 and 318 are individually supported by crank arms 320 and 322. The crank mechanisms, composed of the connecting rods, crankpins, and crank arms, are individually housed in crankcases 324 and 326. These crankcases of the pump assembly are connected with the crankcases 124 and 126 so as to balance pulsations of the crankcase pressure caused by the pistons 308 and 310. Furthermore, the crankcases are connected with the internal space of an air cleaner (not shown in the figure) by positive crankcase ventilation valves (also not shown in the figure).

Figure 2:
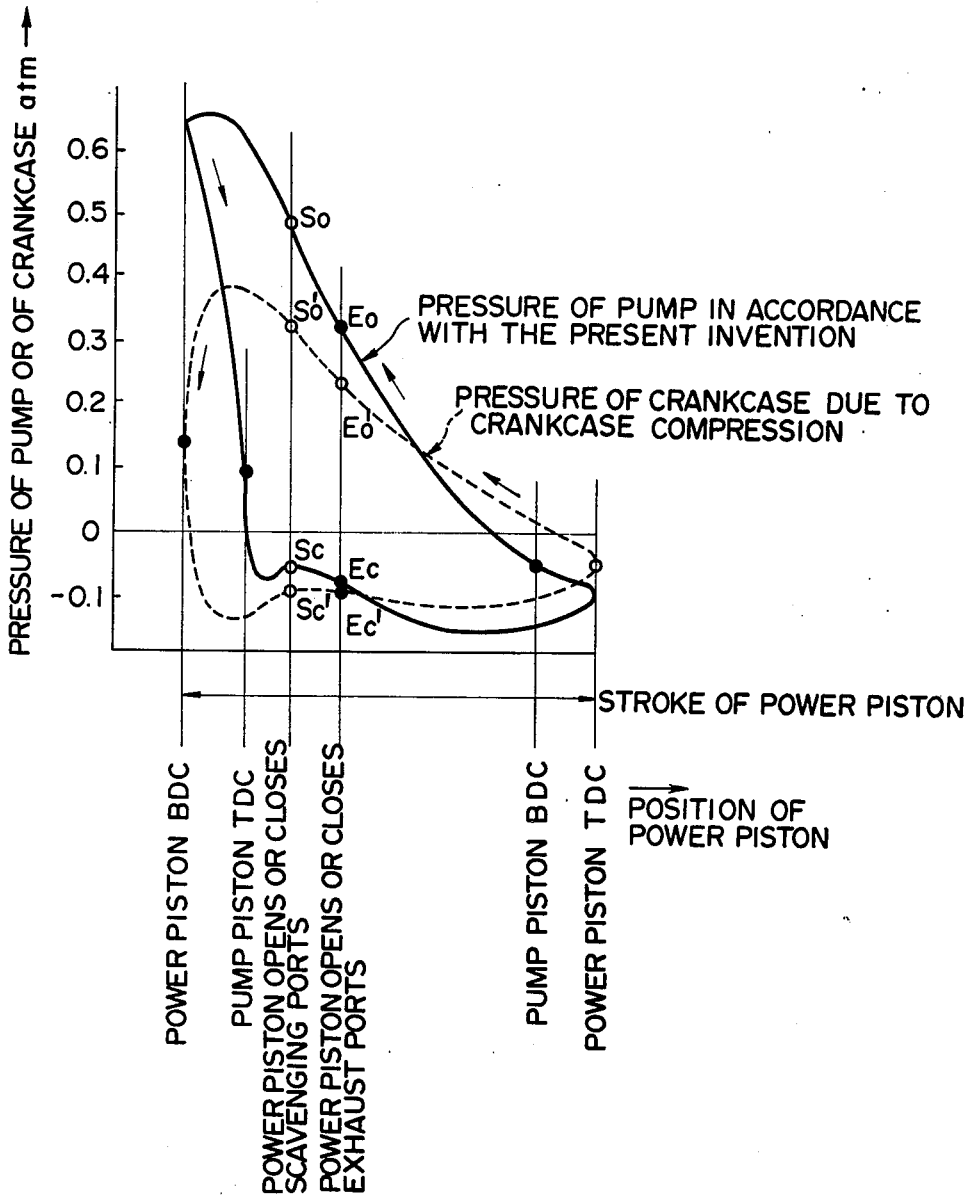
FIG. 2 is a diagram showing the relation between the change of pump pressure and power piston stroke in the two-stroke cycle gasoline engine of the present invention, and the relation between the change of crankcase pressure and power piston stroke in a conventional two-stroke cycle gasoline engine involving crankcase compression, for the purpose of comparison.

40 designates a carburetor which includes a venturi portion 42, a main fuel nozzle 44 which opens to the throat portion of the venturi portion, and a throttle valve 46, and takes in air from its air inlet port located upward in the figure and produces fuel-air mixture in the usual manner. The mixture outlet port of the carburetor 40 is connected with an inlet port 328 of the pump 300 by way of a passage 48. In the passage 48 or in the port 328 is provided a reed valve 330 which allows fluid to flow only toward the pump chamber. The outlet port 332 of the pump 300 is connected with the scavenging plenum 132 of the power assembly 100 by way of a passage 153. In this passage and in proximity to the scavenging plenum 132 is provided a reed valve 142 which prevents blowback of combustion gases from the cylinder 102. If there is no danger of causing such blowback, this reed valve may be omitted. The reed valve 142 serves to interrupt the flow of mixture from the scavenging plenum 132 to the pump cylinder 302 when high vacuum is generated in the pump 300 due to its suction stroke. However, in the present invention, as shown in FIG. 2, the period between pump piston TDC and the exhaust port closing phase point is short, and therefore there exists positive pressure around the scavenging ports due to inertia effect even when the pump 300 has entered its suction stroke. Therefore the drawing action of the pump 300 does not substantially affect scavenging of the power cylinder 102. Therefore, unless the aforementioned blowback of combustion gases should occur, there would exist no reverse flow which would need to be interrupted by the reed valve 142. Nevertheless, in the case of an embodiment wherein pump TDC is located relatively close to power piston BDC, it is desirable that the reed valve 142 should be provided, because although the drawing action of the pump 300 in a range of between about 15° in advance of and about 15° behind its TDC is relatively weak due to a low rate of piston movement, when the crank angle further proceeds, relatively strong drawing action is caused by the pump 300 when compared with conventional crankcase compression.

The crankshafts 12 and 14 are drivingly connected with each other by sprocket wheels 16 and 18 individually mounted on the crankshafts and an endless chain 20 engaged around these sprocket wheels so as to co-rotate in the same direction at the same rotational speed. The phase relation between the crankshafts 12 and 14 is so determined that the crankpins 116 and 118 related with the power pistons 108 and 110 are shifted from each other by a phase difference of 180°. Depending upon this phase relation between the crankshafts 12 and 14 the crankpins 316 and 318 related to the pump pistons 308 and 310 are also shifted from each other by the same phase difference of 180°.

Figure 1:
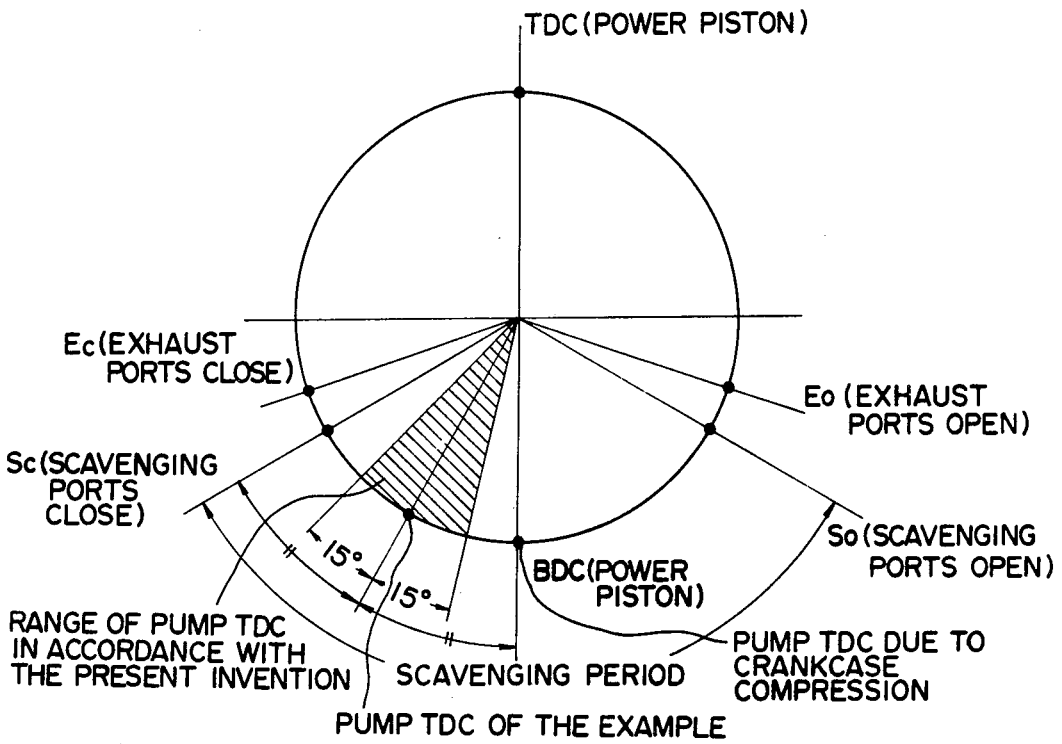
FIG. 1 is a crank angle diagram which explains the operational phase angles of the two-stroke cycle gasoline engine of the present invention.

The exhaust ports 130 are positioned so as to open at such a crank angle as shown in FIG. 1. The scavenging ports 128 are positioned so as to open at a phase position which is slightly retarded from the phase position at which the exhaust ports are opened so that the scavenging ports are opened when the pressure of exhaust gases has lowered. Since the crankpins 116 and 118 are synchronized with each other so as to have a phase difference of 180° therebetween, in FIG. 1 phase point Eo where the exhaust ports are opened and phase point Ec where the exhaust ports are closed are positioned symmetrically with respect to the center line which connects TDC and BDC of the power piston, and similarly phase point So where the scavenging ports are opened and phase point Sc where the scavenging ports are closed are positioned symmetrically with respect to the aforementioned center line.

The operational phase of the pump assembly relative to that of the power assembly, i.e. the phase difference of the crankpin 316 or 318 relative to the crankpin 116 or 118 is so determined that pump TDC is, as viewed in the crank angle diagram, in a range between 15° in advance of and 15° behind the midpoint between power piston BDC and the scavenging port closing phase point Sc. This phase range is the hatched range in the crank angle diagram of FIG. 1. In the embodiment shown in FIG. 1 the crank angle between scavenging port opening phase point So and power piston BDC and the crank angle between power piston BDC and scavenging port closing phase point Sc are each 60°. Furthermore, in this case if pump TDC is located just at the aforementioned midpoint it will then be located 30° behind the power piston BDC. In this embodiment, therefore, the crankpin 316 or 318 is positioned 210° by crank angle behind the crankpin 116 or 118, respectively. In this case, therefore, when the scavenging ports are opened (So), the pump pistons 308 and 310 are advanced a half of their compression stroke. If the volumetric efficiency of the pump is 100%, and if its clearance volume is zero, pump delivery pressure will be 2 ata (absolute pressure). However, since the volumetric efficiency of the pump is in practice usually less than 100%, and since there exists a certain clearance volume with respect to the passage 153, scavenging plenum 132, etc., the scavenging pressure at scavenging port opening phase point So will be a value such as 1.5–1.6 ata (0.5–0.6 atm).

As mentioned above, the stroke volume of the pump assembly 300 is determined to be 1.15–1.65 times as large as the total stroke volume of the power cylinder-piston assembly. If in this case it is assumed that the stroke of the pump piston is the same as the stroke of the power piston, the ratio of the inner diameter of the pump cylinder 302 to the inner diameter of the power cylinder 102 should be the square root of 1.15–1.65. Thus the pump pistons 308 and 310 should be relatively greater than the power pistons 108 and 110 in diameter, whereby the connecting rods 312 and 314 should be correspondingly larger, thereby requiring correspondingly large mass balancers being incorporated in the crank arms 320 and 322. The reciprocating inertia forces due to the pump pistons 308 and 310 are cancelled by each other so that they produce no external effect. However the crankshafts are burdened with correspondingly high load.

As mentioned above, the ratio of the stroke volume of the pump cylinder-piston assembly 300 to the total stroke volume of the power cylinder-piston assembly 100 is determined to be in the range of 1.15–1.65. Further, a particular value in this range which is to be selected in actual design is determined as follows. First, the rotational speed of the engine which should be employed with the highest frequency for full throttle operation is determined, and then the stroke volume of the pump 300 is so determined that when the engine is operating at the above-determined rotational speed, scavenging mixture pushes exhaust gases just completely out of the exhaust ports 130 when the exhaust ports are closed by the piston 110 on the exhaust side. The pressure in the pump cylinder 302 changes as shown in FIG. 2, and when the scavenging ports are opened (So), it has the value of point So in the diagram. Although scavenging mixture is drawn at this pressure through the scavenging ports 128 into the power cylinder 102, the scavenging mixture is slightly throttled by the scavenging ports. The scavenging mixture discharged from the scavenging ports flows through the power cylinder toward the exhaust ports 130 while forming a spiral flow. In this case the flows of scavenging mixture discharged from the scavenging ports 128*a* collide with each other at the center of the cylinder, and then the mixture flows along the central axis of the cylinder toward the scavenging ports. The time required for the scavenging mixture to reach the scavenging ports is determined by the difference of pressure between the scavenging mixture and the combustion gases existing in the cylinder, and the distance travelled by the spiral flow of scavenging mixture while it flows from the scavenging ports to the exhaust ports, and this time is not directly related with the rotational speed of the engine. In this connection, although a part of the scavenging mixture proceeds along the central axis of the cylinder, the amount of this part of scavenging mixture is relatively small as compared with the amount of scavenging mixture which flows as a spiral flow and does not substantially affect the time determined by the spiral flow. If the arrangement of the scavenging and exhaust ports is determined, the aforementioned time now changes in accordance with the scavenging pressure at So and also in accordance with its subsequent changes, i.e. this time is determined in accordance with the behavior of the scavenging mixture in the power cylinder 102, which is determined by the scavenging pressure at So and in accordance with how the scavenging mixture which already exists in the power cylinder 102, is backed up by the scavenging mixture subsequently discharged after the phase point So. In this case, the aforementioned time is shortened as the scavenging pressure at So is higher and as the subsequent scavenging pressure is higher. Since the scavenging pressure delivered from the pump 300 is throttled by the scavenging ports 128, when the stroke volume of the pump is larger, and therefore when the delivery amount of the pump is larger, the scavenging pressure after the phase point So is higher. According to the present invention such high scavenging pressure is maintained for a relatively long time during the scavenging period.

If the suction inertia effect is neglected, the volumetric efficiency of a reciprocating pump becomes higher as its rotational speed becomes lower. Furthermore, the time required for the scavenging mixture to reach the exhaust ports is not determined by scavenging pressure, exhaust pressure, arrangement of the scavenging and exhaust ports etc. and is not directly concerned with the rotational speed of the engine. Therefore, if the engine is so matched that at a certain rotational speed (which is called "matching rotational speed") when scavenging mixture has just pushed exhaust gases out of the exhaust ports, the exhaust ports should be closed, then below the matching rotational speed blow-out escaping of mixture to the exhaust manifold will occur, while on the other hand above the matching rotational speed exhaust gases will remain in the cylinder 102. Therefore, if it is intended that the engine should produce high torque at high rotational speed, the stroke volume of the pump 300 must be increased so as to increase the scavenging pressure. In this case, when the engine is operated at low speed with full throttle, blow-out of mixture to the exhaust manifold will increase. When there exists an exhaust inertia effect in the exhaust pipe, this will also affect the time required for the exhaust gases to reach the exhaust ports. If the stroke volume of the pump is too small, due to the effect of the clearance volume and the throttling action by the scavenging ports the scavenging pressure at the scavenging port opening phase point So will not be high enough so that the scavenging pressure will remain almost without increasing after the opening of the scavenging ports or will abruptly lower. On the other hand, if the stroke volume of the pump is too large, the scavenging pressure after So will become too high. In this case, due to such a high scavenging pressure the scavenging mixture will mix with exhaust gases so as to cause blow-out of scavenging mixture to the exhaust manifold, while on the other hand a part of the scavenging mixture delivered from the pump remains in the passage located before the scavenging ports, without being effectively introduced into the power cylinder 102, when the scavenging ports are closed. If a large amount of scavenging mixture remains in such a passage, although a part of the work consumed for the compression of scavenging mixture is revived as the force for driving the pump in the next suction stroke, pumping power required will increase thereby decreasing the effective output power of the engine.

By taking these conditions into consideration the stroke volume of the pump is determined. Then an engine for test is manufactured, and in accordance with the process of experiments the stroke volume of the pump is modified so as to satisfy the requirements with regard to engine performance and with regard to exhaust gas purification. As a result of such experimental researches, we have found that when the total stroke volume of the scavenging pump is 1.15–1.65 times as large as the total stroke volume of the power assembly, the engine can satisfy the aforementioned requirements in a desirable manner.

The operation of the embodiment shown in FIGS. 3–5 will now be described. It is assumed that the phase relations in this embodiment are adjusted as shown in the crank angle diagram in FIG. 1. When the pump pistons 308 and 310 move from their TDC toward their BDC, the reed valve 330 is opened, and mixture is drawn from the carburetor 40 toward the pump cylinder 302. The power pistons 108 and 110 move from their TDC toward their BDC, and when they have moved 30° by crank angle from their TDC, the pump passes its BDC and enters its compression stroke. The reed valve 330 is then closed, but when the delivery pressure of the pump has overcome the spring force of the reed valve 142, the valve is opened, and scavenging mixture flows into the scavenging plenum 132. Then, first the exhaust ports 130 are opened, and exhaust gases are exhausted through the exhaust plenum 134 and through the exhaust pipes 136. After the lapse of a time interval during which the exhaust pressure has sufficiently lowered, the scavenging side piston 108 opens the scavenging ports 128, whereby scavenging mixture flows into the cylinder 102. At this time the scavenging pressure is at the level of point So in FIG. 2, and the scavenging pressure changes in substantially the same manner as the pump pressure shown in FIG. 2. In fact, however, the scavenging pressure is affected by various factors as mentioned above. For example, if the reed valve 142 is in the substantially closed state after the scavenging plenum 132 has been filled by scavenging mixture, there occurs a slight temporary reduction of the scavenging pressure in the period which follows the initial discharge of scavenging mixture from the scavenging ports 128 and which is before the reed valve 142 is opened. However, if the engine is operating at such a high rotational speed that the scavenging ports 128 are opened immediately after the scavenging plenum 132 has been filled with scavenging mixture, the reed valve 142 is still open, and the abovementioned temporary reduction of the scavenging pressure does not occur. The pump reaches its TDC at the phase point 30° by crank angle in advance of the end of the scavenging period. However, since the pump piston does not move much within the range of about 15° by crank angle behind its TDC, and since the drawing action of the pump in this region is weak, if the stroke volume of the pump is so large as to provide a certain large amount of scavenging mixture, the flowing-in of scavenging mixture into the power cylinder 102 continues due to inertia effect over a substantial region of the latter half of the scavenging period located behind pump TDC, thereby increasing the volumetric efficiency of the power cylinder. The speed of the scavenging mixture which flows from the pump delivery port 332 to the scavenging ports 128 and the speed of the scavenging mixture which flows into the cylinder 102 through the scavenging ports 128 are not directly related with the rotational speed of the engine, while on the other hand the time which lapses between pump TDC and the scavenging port closing phase point Sc changes in accordance with the rotational speed of the engine so that it is shortened as the rotational speed of the engine increases. Therefore, at a certain rotational speed of the engine the flowing-in of scavenging mixture into the cylinder 102 will continue over the entire region of the scavenging mixture. When the pistons 108 and 110 further move, the scavenging ports 128 are closed by the piston 108 on the scavenging side, and then the exhaust ports 130 are closed by the piston 110 on the exhaust side, and then the engine enters its compression stroke so that the mixture is compressed and is then ignited by the ignition plug 156 some time before power piston TDC, and then the power cylinder enters its combustion stroke.

Figure 7:
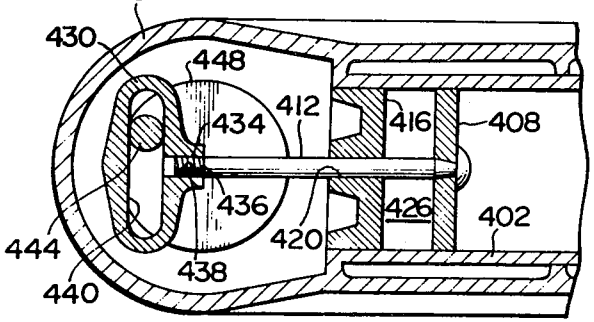
FIG. 7 is a sectional view along line VII—VII in FIG. 6.
Figure 6:
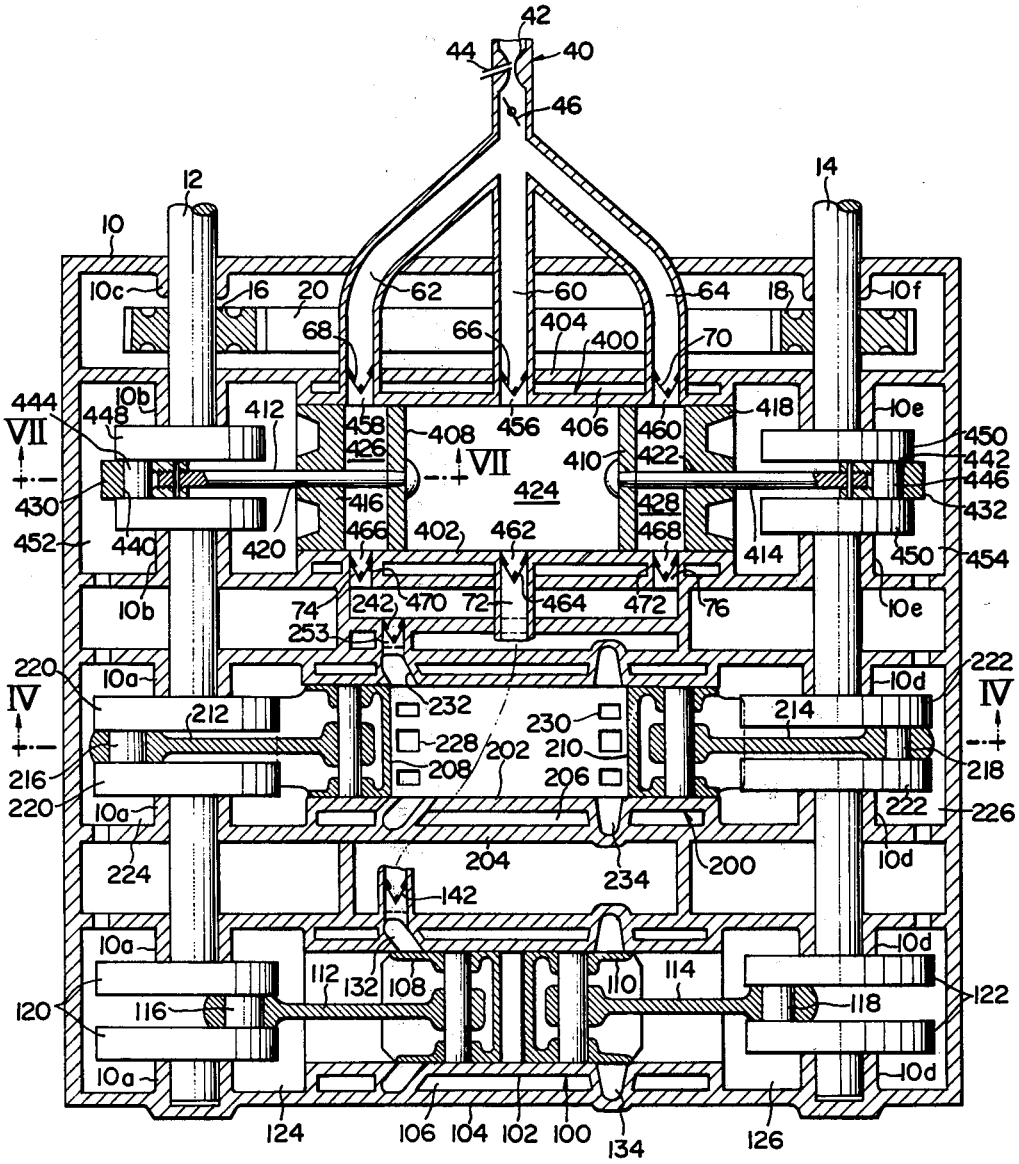
FIG. 6 is a diagrammatical plan sectional view similar to FIG. 3, showing a second embodiment of the present invention.

FIG. 6 is a view similar to FIG. 3, showing a second embodiment of the present invention, and FIG. 7 is a sectional view along line VII—VII in FIG. 6. In FIGS. 6 and 7 the portions corresponding to those shown in FIGS. 3–5 are designated by the same reference numerals. In this second embodiment, in addition to the power cylinder-piston assembly 100 of the two-stroke cycle uniflow scavenging horizontally opposed piston type is incorporated a second power cylinder-piston assembly 200 having substantially the same structure as the first power cylinder-piston assembly 100. In FIG. 6, therefore, the portions of the second power cylinder-piston assembly 200 corresponding to those of the first power cylinder-piston assembly 100 are designated by reference numerals which are the reference numerals attached to the corresponding portions of the first cylinder-piston assembly 100, each increased by 100. As apparent from FIG. 6, the power pistons 108 and 110 of the first power cylinder-piston assembly 100 and the power pistons 208 and 210 of the second power cylinder-piston assembly 200 are individually shifted by a phase difference of 180°.

Further, as apparent from FIG. 6, also in this second embodiment the crankcases 124, 126 and 224, 226 of the power cylinder-piston assemblies 100 and 200 are not used for crankcase compression. In this case, if the scavenging in the two power cylinder-piston assemblies is to be done by a single acting pump cylinder-piston assembly having two horizontally opposed pistons and having a piston stroke comparable with that of the power pistons from the viewpoint of obtaining the overall dimensional harmony of the engine, the diameter of the pump will become very large and in this regard dimensional harmony between the pump assembly and the power assemblies will not be attained. On the contrary, if the diameter of the cylinder of such a single acting pump cylinder-piston assembly is to be maintained in such a value as to be comparable with the diameter of the power cylinder, the stroke of the pump pistons will become very large so that in this case the crank mechanism of the pump will be incompatible with the crank mechanism of the power assembly. Furthermore, in this case the swing angle of the connecting rod in the pump assembly will become too large to construct a practical pump assembly. These problems will be avoided if two single acting pump cylinder-piston assemblies having horizontally opposed pistons are employed as arranged side by side as the first and second power cylinder-piston assemblies. In this case, however, the length of the engine, i.e. the dimension along the crankshafts, will become relatively large, and this reduces the merit of compactness of the engine.

In view of these problems, in this second embodiment the scavenging pump means, which must supply a relatively large amount of scavenging mixture in accordance with the present invention to the two power cylinder-piston assemblies of the two-stroke cycle uniflow scavenging opposed piston type without involving crankcase compression, is constructed as a double acting pump cylinder-piston assembly 400 having two horizontally opposed pistons. The pump assembly 400 has a pump cylinder 402 supported by the cylinder block 10 and surrounded by a cooling jacket 406 defined by a jacket wall 404. In the pump cylinder 402 are opposedly provided a pair of disk-like pump pistons 408 and 410 which are individually connected with push rods 412 and 414 which individually extend through openings 420 and 422 formed in end plates 416 and 418 which close opposite ends of the pump cylinder 402. The openings 420 and 422 are individually constructed as bearing openings which slidably and sealingly receive the push rods 412 and 414, respectively. By this arrangement the inside of the pump cylinder 402 is divided into three pump chambers 424, 426, and 428. The other end of the push rods 412 and 422 are, as better shown in FIG. 7, individually connected with O-members 430 and 432. As shown in FIG. 7 with respect to the connection between the push rod 412 and the O-member 430, the end of the push rod 412 is formed with a threaded portion 436 which is screwed into a correspondingly threaded opening 434 formed in the O-member 430, and the screw engagement is fixed by a pin 438. The O-members 430 and 432 individually have grooves 440 and 442 in which are individually engaged crankpins 444 and 446 which are individually supported by crank arms 448 and 450, each being constructed as a pair of crank arms. Crankcases 452 and 454 housing individually the crank mechanisms constructed by the aforementioned crank arms, etc. are connected with the crankcases 124, 224, and 126, 226 of the power assemblies 100 and 200, and furthermore these crankcases are connected with the inside of an air cleaner not shown in the figure by way of a positive crankcase ventilation valve also not shown in the figure so as to control pressure fluctuation in the crankcases.

The outlet of the carburetor 40 is connected with ports 456, 458 and 460 individually opening to the pump chambers 424, 426 and 428 by way of passages 60, 62 and 64, respectively. In these passages are provided, as located close to the ports 456, 458 and 460, reed valves 66, 68 and 70, respectively. The ports 458 and 460 are individually so positioned that they positively open individually to the pump chambers 426 and 428 without interfering with the pistons 408 and 410 even when these pistons have come to their BDC with respect to the pump chamber 424. The pump chamber 424 is connected, by way of its delivery port 462 and the passage 72, with the scavenging plenum 132 of the first power assembly 100 so as to supply scavenging mixture to said first power asembly. On the other hand, the pump chambers 426 and 428 are connected, by way of their delivery ports 466 and 468 and the passages 74 and 76, respectively, with the scavenging plenum 232 of the second power assembly 200 so as to supply scavenging mixture to said second power assembly.

The section taken along line IV—IV in FIG. 6 presents a view similar to that shown in FIG. 4. In this case, however, the reference numerals attached in FIG. 4 must be modified by changing the first figure in each reference numeral from "1" to "2".

The ratio of the pumping stroke volume of the pumping chamber 424 to the stroke volume of the power cylinder-piston assembly 100 and the ratio of the sum of the pumping stroke volumes of the pumping chambers 426 and 428 to the stroke volume of the power cylinder-piston assembly 200 should be individually determined in the same manner as in the first embodiment. Also in this case it is possible to obtain an engine which satisfies the requirements with regard to engine performance and to the standard for exhaust gas purification in a desirable manner by limiting the ratio within the range of 1.15–1.65.

Also in this second embodiment, the operational phases of the individual pumping chambers of the pump 400 are determined relative to the operational phases of the first and second power assemblies 100 and 200, respectively, in the same manner as explained in reference to the first embodiment. In this case the first and second power assemblies 100 and 200 are synchronized with each other so as to involve a phase difference of 180° therebetween. On the other hand, with respect to the pump assembly 400, the phase difference between the pumping chamber 424 and the pumping chambers 426 and 428 is exactly 180°. That is, when the pump pistons 408 and 410 come closest to each other, the pumping chamber 424 is in its TDC, while the pumping chambers 426 and 428 are in their BDC. On the contrary, when the pump pistons 408 and 410 diverge to be remotest from each other, the pumping chamber 424 is in its BDC, while the pumping chambers 426 and 428 are in their TDC. When the operational phase of the pumping chamber 424 relative to that of the power assembly 100 is properly adjusted in the manner as shown in FIG. 1, the operational phases of the pumping chambers 426 and 428 relative to the power assembly 200 are automatically adjusted in the same phase difference relation. Thus the pressure path as shown in FIG. 2 is obtained with respect to the individual combinations of the power assemblies and pumping means.

Although it is desirable that the clearance volume of the pumping chambers 426 and 428 should be as small as possible, if it is so designed, the push rods 412 and 414 will be supported only like a cantilever when the pistons 408 and 410 are in their BDC with respect to the pumping chamber 424, and the structural stability and durability of the push rods and the related mechanisms will deteriorate. Such a problem can be obviated, if, for example, the end plates 416 and 418 are thickened or formed like a box so as to reduce the base volume of the pumping chambers 426 and 428. By taking this matter into consideration, in the shown embodiment the pumping chambers 426 and 428 are connected with the power assembly 200 by way of relatively short passages 74 and 76, while on the other hand the pumping chamber 424 is connected with the power assembly 100 by way of a relatively long passage 72 so that the clearance volumes related to the two pumping chambers are well balanced.

In the pumping assembly 400 the reciprocating inertia force is relatively large than its rotary inertia force. However, the reciprocating inertia force is internally cancelled and does not give any external effect.

Figure 8:
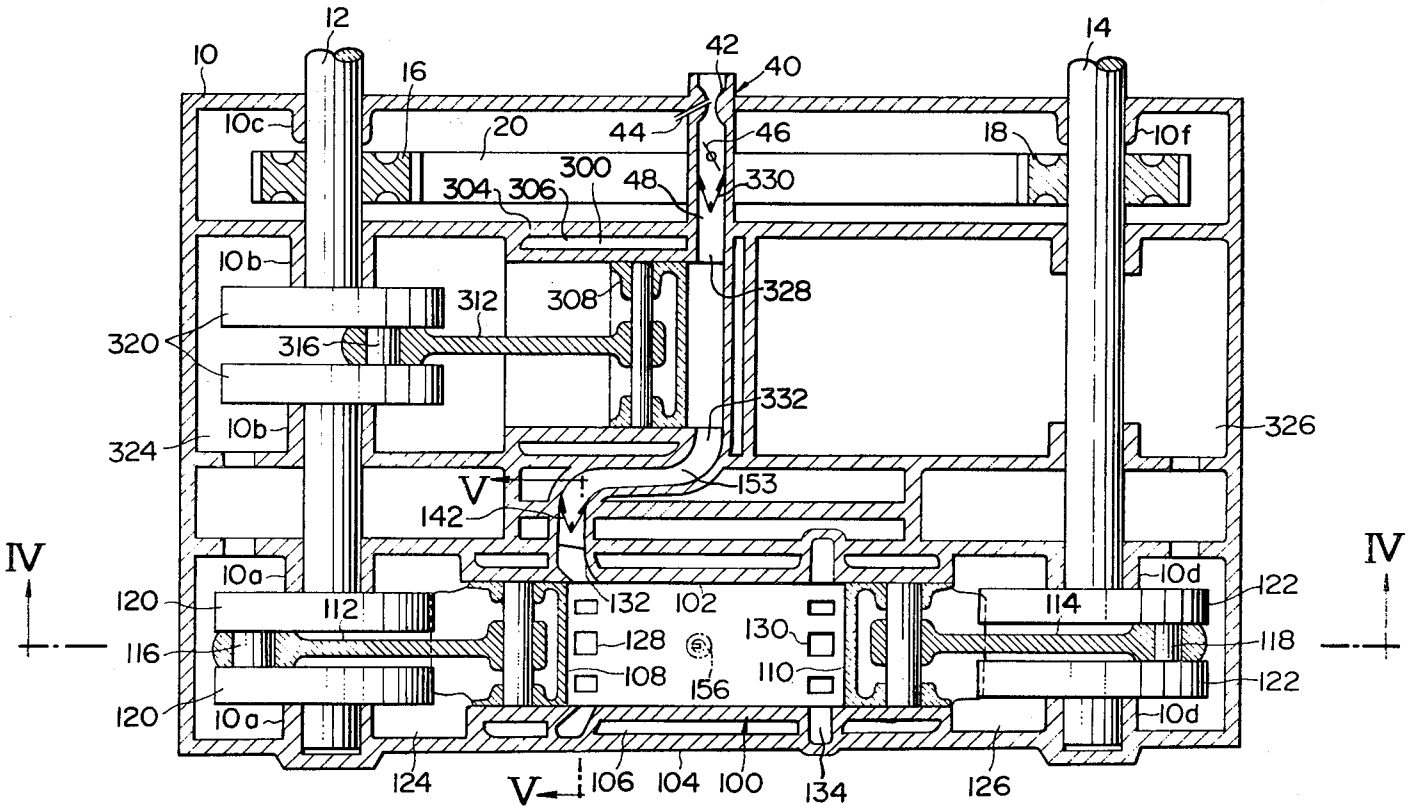
FIG. 8 is a view similar to FIG. 3, showing a third embodiment of the present invention.

FIG. 8 is a view similar to FIG. 3, showing a third embodiment of the present invention. In this embodiment the pump assembly 300 is constructed as a single piston reciprocating type pump cylinder-piston assembly. As apparent from FIG. 8 the engine herein shown has the structure in which the right half portion of the pump assembly 300 in the first embodiment shown in FIG. 1, i.e. substantially a half of the pump cylinder 302, piston 310, connecting rod 314, crankpin 318 and crank arm 322, have been deleted. In FIG. 8 the portions corresponding to those shown in FIG. 3 are designated by the same reference numerals, and these corresponding portions operate in the same manner in both embodiments. When such a single piston pump assembly is employed, there are disadvantages with regard to the dimensions of the pump piston relative to the power piston and with regard to dynamic balance of the pump assembly when compared with a pump assembly of the horizontally opposed piston type, as explained hereinabove. However, in this case the manufacturing cost is reduced, and when the engine is small sized the balance and dimensional disadvantages can be sufficiently compensated for by the cost advantage.

Since the structure and operation of other portions of the embodiment shown in FIG. 8 are substantially the same as those of the embodiment shown in FIG. 3, detailed explanations for those will be omitted in order to avoid duplication.

Although the invention has been shown and described with respect to some preferred embodiments thereof, it should be understood by those skilled in the art that various changes and omissions of the form and detail thereof may be made therein without departing from the scope of the invention.

We claim:

1. A two-stroke cycle gasoline engine comprising at least one two-stroke cycle power cylinder-piston assembly incorporating uniflow scavenging and two horizontally opposed pistons, at least one scavenging pump cylinder-piston assembly of the reciprocating type and driven by said power cylinder-piston assembly in synchronization therewith with a phase difference, wherein the total stroke volume of said pump cylinder-piston assembly is between 1.15 and 1.65 times as large as that of said power cylinder-piston assembly, and said phase difference between said power and pump cylinder-piston assemblies is so determined that the top dead center of a pump cylinder-piston assembly is, as viewed in the crank angle diagram, in a range between 15° in advance of and 15° behind the midpoint between the bottom dead center and the scavenging port closing phase point of the power cylinder-piston assembly to which is supplied scavenging mixture.

2. The engine of claim 1, further comprising a carburetor, a passage means for supplying fuel-air mixture from said carburetor to said pump cylinder-piston assembly, and another passage means for conducting fuel-air mixture from said pump cylinder-piston assembly to said power cylinder -piston assembly.

3. A two-stroke cycle gasoline engine comprising first and second two-stroke cycle power cylinder-piston assemblies each incorporating uniflow scavenging and two horizontally oposed pistons, said two power cylinder-piston assemblies being connected with each other so as to operate in synchronization with each other with a phase difference of 180° therebetween, and a double acting pump cylinder-piston assembly having two horizontally opposed pistons so as to define a central pump chamber and two opposite pump chambers, said central pump chamber serving for supplying scavenging mixture to said first power cylinder-piston assembly while said two opposite pump chambers serving for supplying scavenging mixture to said second power cylinder-piston assembly, said pump cylinder-piston assembly being driven by said power cylinder-piston assemblies in synchronization therewith with a phase difference, wherein the stroke volume of said central pump chamber and the total stroke volume of said two opposite pump chambers are indivually between 1.15 and 1.65 times as large as the stroke volume of said first and second power cylinder-piston assemblies, and said phase difference between said power and pump cylinder-piston assemblies is so determined that the top dead center of said center pump chamber and of said two opposite pump chambers is, as viewed in the crank angle diagram, in a range between 15° in advance of and 15° behind the midpoint between the bottom dead center and the scavenging port closing phase point of said first and second power cylinder-piston assemblies.

4. The engine of claim 3, further comprising a carburetor, a passage means for supplying fuel-air mixture from said carburetor individually to said central and two opposite pump chambers, another passage means for conducting fuel-air mixture from said central pump chamber to said first power cylinder-piston assembly, and still another passage means for conducting fuel-air mixture from said two opposite pump chambers to said second power cylinder-piston assembly.

5. The engine of claim 4, wherein said second power cylinder-piston assembly is located closer to said pump cylinder-piston assembly than said first power cylinder-piston assembly.

6. The engine of claim 1, wherein said pump cylinder-piston assembly of the reciprocating type has two horizontally opposed pistons.

7. The engine of claim 1, wherein said pump cylinder-piston assembly of the reciprocating type has a single pump piston.

8. The engine of any one of the claims 1–7, wherein said power cylinder-piston assembly and said pump cylinder-piston assembly are horizontally arranged side by side and have a pair of common crankshafts arranged along opposite ends of the assemblies.

9. The engine of claim 8, further comprising a pair of sprocket wheels individually mounted on said pair of crankshafts and an endless chain engaged around said pair of sprocket wheels so that said pair of crankshafts are drivingly connected with each other so as to rotate in the same direction in synchronization with each other.

* * * * *